US006762381B2

(12) United States Patent
Kunthady et al.

(10) Patent No.: US 6,762,381 B2
(45) Date of Patent: Jul. 13, 2004

(54) KEY TOP FOR PUSHBUTTON SWITCH AND METHOD OF PRODUCING THE SAME

(75) Inventors: Tedi Kunthady, Iwatsuki (JP); Atsushi Hikita, Kita-ku (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 10/195,674

(22) Filed: Jul. 12, 2002

(65) Prior Publication Data

US 2003/0034241 A1 Feb. 20, 2003

(30) Foreign Application Priority Data

Jul. 16, 2001 (JP) ..... 2001-215815
Apr. 4, 2002 (JP) ..... 2002-102753

(51) Int. Cl.[7] ..... H01H 13/70
(52) U.S. Cl. ..... 200/512; 200/341
(58) Field of Search ..... 200/512–514, 200/517, 516, 314, 5 A, 341, 345; 29/622

(56) References Cited

U.S. PATENT DOCUMENTS 5,005,949 A * 4/1991 Egawa et al. ..... 362/354
5,935,691 A 8/1999 Tsai ..... 428/195
6,023,033 A * 2/2000 Yagi et al. ..... 200/512
6,321,441 B1 * 11/2001 Davidson et al. ..... 200/512
6,322,875 B1 * 11/2001 Kimura ..... 428/195

FOREIGN PATENT DOCUMENTS

JP 05-065687 3/1993 ..... C25D/5/02
JP 07-245190 9/1995 ..... H05F/1/00
JP 10-233137 9/1998 ..... H01H/13/02
JP 10289633 A * 10/1998 ..... H01H/13/14
JP 11-027362 1/1999 ..... H04M/1/22
JP 11-066997 3/1999 ..... H01H/13/02
JP 11-003581 7/2000 ..... H01H/11/00

* cited by examiner

*Primary Examiner*—Elvin Enad
*Assistant Examiner*—M. Fishman
(74) *Attorney, Agent, or Firm*—Fish & Neave; Robert R. Jackson; Philip R. Poh

(57) ABSTRACT

According to a method of producing a key top for a pushbutton switch of the present invention, a base layer made of an insulating resin that can be plated with metal, an electroless plating layer to be formed on the surface of the base layer, and a polymer coating layer, if required, are stacked on the surface of a key top body. Alternatively, an electroplating layer formed by electroplating is further formed on the electroless plating layer. Therefore, a plating layer can be directly and easily formed on the insulating resin, whereby a key top for a pushbutton switch having a sensation of metal and being rich in design is obtained.

14 Claims, 8 Drawing Sheets

KEY TOP FOR PUSHBUTTON SWITCH AND METHOD OF PRODUCING THE SAME

BACKGROUND OF THE INVENTION

1. Field of the Invention

The present invention relates to a key top used as a pushbutton switch for various mobile communication devices such as a mobile phone and an automobile telephone, a remote control, or car-mounted electronic equipment.

2. Description of the Related Art

As a material for a key top for a pushbutton switch of various mobile communication devices and electronic equipment, such as a mobile phone and a remote control, resins are mainly used for reasons such as a satisfactory sensation of an operation and rich design variations. In terms of enhancement of design, there is a demand for a sensation of a metal-type material with lustrousness of metal (in the present specification, referred to as a "sensation of metal") and illumination of a display portion displaying a letter, a symbol, or the like.

In order to satisfy the above-mentioned demand, in the case of providing a sensation of metal to a key top by utilizing a resin material, a key top made of a resin is produced by a following method in which a metal layer is formed in a desired position of the surface of a key top made of a resin by vapor deposition or sputtering (first prior art) or a method in which a resin to be plated with metal and a resin that is not to be plated with metal are subjected to coinjection molding, whereby a plating layer is provided on the resin to be plated with metal (second prior art).

Alternatively, a key top made of a resin has also been produced by a method in which a coating with a sensation of metal is applied (third prior art) or a method in which an electroplating layer formed on the surface of a resin to be plated with metal is etched with a laser to form a letter, a symbol, or the like (fourth prior art).

However, according to the method of the first prior art, the metal layer formed by vapor deposition or sputtering is thin. Therefore, when a key top made of a resin is repeatedly pressed down, the metal layer wears away and may eventually disappear. In order to solve this problem, the surface of the metal layer is coated with a protective layer, the metal layer is formed on the reverse surface of a flat resin film, and the resultant film is curved along the surface of a key top made of a resin to be integrated with a key top body, and the like. According to the former method, dust is likely to adhere during coating. According to the latter method, the metal layer is likely to be cracked when the resin film is curved. In both methods, the yield is poor and the cost is high.

According to the method of the second prior art, the display portion is designed by coinjection molding. Therefore, a display portion with minute and complicated designs cannot be realized and the cost is high.

According to the method of the third prior art, compared with the case where the metal layer is formed by plating, it is difficult to provide a smooth mirror surface, and wear resistance is not satisfactory. According to the method of the fourth prior art, unless a laser treatment is conducted after plating, it is difficult to form, in particular, letters containing an island portion isolated from the periphery, such as digits "9" and "0", and it is difficult to adjust a laser output for forming a display portion without influencing regions on the periphery of a letter, a symbol, or the like.

Jp 2000-207985 A describes a method of producing a key top by coating a desired site with a conductive ink, and plating the site coated with the conductive ink. However, according to this method, in order to decrease a resistance of the conductive ink, it is required to use silver powder or copper powder, which makes the conductive ink expensive, resulting in a high cost.

SUMMARY OF THE INVENTION

Therefore, with the foregoing in mind, it is an object of the present invention to provide a key top for a pushbutton switch having a sensation of metal, a rich design, a satisfactory yield, a low cost, the capability of being illuminated, and excellent durability.

In order to achieve the above-mentioned object, according to the present invention, a key top for a pushbutton switch in which a base layer made of an insulating resin that can be plated with metal and an electroless plating layer formed on the surface of the base layer are stacked on a key top body is provided.

In the key top for a pushbutton switch, the base layer made of an insulating resin that can be plated with metal is formed on a surface of the key top body, and the electroless plating layer is formed on a surface of the base layer. Therefore, the plating layer can be provided directly and easily on the insulating resin. As a result, a key top for a pushbutton switch can be obtained, which has a sensation of metal while using a resinous key top body, rich design, a satisfactory yield, and a low cost.

Furthermore, according to the present invention, there is provided a key top for a pushbutton switch in which a polymer coating layer is formed on the surface of the base layer, wherein the electroless plating layer is formed on the surface of the base layer where the polymer coating layer is not formed.

The electroless plating layer is formed on the surface of the base layer where the polymer coating layer is not formed. Therefore, a display portion, a pattern, and the like can be formed by the electroless plating layer and the polymer coating layer. As a result, a key top for a pushbutton switch having an improved design can be obtained. Furthermore, the periphery of the electroless plating layer is in contact with the polymer coating layer, so that the ends of the electroless plating layer can be protected by the polymer coating layer, and wear and a loss of the electroless plating layer can be prevented. Furthermore, during production, the polymer coating layer functions as a masking layer for a region where the electroless plating layer is not formed, so that the electroless plating layer can be easily attached to a desired place. As a result, a key top for a pushbutton switch that has the capability of being mass-produced at a low cost can be obtained.

Furthermore, according to the present invention, a key top for a pushbutton switch having an electroplating layer further formed by electroplating on the electroless plating layer is provided.

When the electroplating layer further formed by electroplating is provided on the electroless plating layer, a key top for a pushbutton switch can be obtained, which has enhanced wear resistance, lustrousness, and a sensation of metal.

Furthermore, according to the present invention, a key top for a pushbutton switch in which a polymer coating layer is further provided on the surface of the electroless plating layer or the electroplating layer is provided.

When the polymer coating layer is further provided on the surface of the electroless plating layer or the electroplating layer, these plating layers are protected by the polymer coating layer. Thus, wear and a loss of the plating layer can be prevented, and as a result, a key top for a pushbutton switch having enhanced wear resistance can be obtained. More specifically, even if the key top is pressed down repeatedly, the plating layer is unlikely to peel off. Furthermore, coloring that is not present on the key top body can be provided to the surface of the key top. For example, if the polymer coating layer is formed as a colored transparent layer, light reflected from the plating layer comes in the eyes of a human through the colored transparent polymer coating. Therefore, the key top surface having coloring that cannot be obtained only with the plating layer can be formed, which enables the design to be richer. In particular, even if a part of the plating layer forms a display portion of a letter, a symbol, or the like, the letter, the symbol, or the like does not peel off. Thus, a key top surface having enhanced durability with an enhanced design can be obtained.

According to the present invention, there is provided a key top for a pushbutton switch in which the polymer coating layer and the plating layer are formed so as to be visually recognized.

In the key top for a pushbutton switch, the plating layers including the electroless plating layer and the electroplating layer, and the polymer coating layer can directly form a display portion, and a key top surface with durability and coloring that cannot be obtained by vapor deposition or sputtering can be obtained. Furthermore, a key top for a pushbutton switch can be obtained, which has an enhanced design provided with a sensation of metal due to the difference in color between the polymer coating layer and the plating layers.

According to the present invention, a key top for a pushbutton switch in which a key top body comprises a resin film and a resin base that are integrated with each other is provided.

In the key top for a pushbutton switch in which the key top body comprises the resin film and the resin base that are integrated with each other, a flat resin film can be coated with the base layer and the polymer coating layer, and a coating operation of the base layer and the like is easy. Thus, a key top for a pushbutton switch can be obtained at a low cost.

Furthermore, according to the present invention, a key top for a pushbutton switch that may be illuminated is provided, in which the key top body is made of a transparent resin, and the transmittance of visible light of the base layer is in the range from 3% to 95%.

When the key top body is made of a transparent resin and the transmittance of visible light of the base layer is in the range from 3% to 95%, a key top for a pushbutton switch having a sensation of metal and an improved design, and that is capable of being pressed without fail even at night or in a dark place can be obtained.

Furthermore, in order to achieve the above-mentioned object, according to the present invention, a method of producing a key top for a pushbutton switch, in which the surface of a key top body is coated with a liquid resin to form an insulating base layer to be plated with metal, and then an electroless plating layer is formed on the surface of the base layer by electroless plating is provided.

According to the above-mentioned production method, the plating layer can be provided directly and easily on the insulating base layer, and minute and complicated designs can be provided on a key top. Thus, a key top having a desirable appearance and enhanced design can be produced. In particular, compared with the case where electroplating is provided, operation processes can be shortened, and a key top for a pushbutton switch with a sensation of metal can be produced at a low cost. Furthermore, the electroless plating layer can be made thicker to some degree. Therefore, a key top for a pushbutton switch having enhanced durability and design can be obtained.

Furthermore, according to the present invention, a method of producing a key top for a pushbutton switch, in which a part of the surface of the base layer is coated with polymer coating ink to form a polymer coating layer, and an electroless plating layer is formed on the surface of the base layer where the polymer coating layer is not formed by electroless plating is provided.

According to the above method, the polymer coating layer is previously formed on the surface of the base layer before the electroless plating layer is formed, so that the polymer coating layer is not plated. Therefore, two layers, a layer to be plated and a layer that is not to be plated, can be easily formed on the surface of a key top. Thus, a key top for a pushbutton switch, in which a display portion is formed easily and which is excellent in variation of design, can be easily provided.

According to the present invention, a method of producing a key top for a pushbutton switch in which an electroplating layer is further stacked on the electroless plating layer by electroplating is provided.

According to the above production method, the electroless plating layer becomes a base layer for attaching an electroplating, and the electroplating layer can be provided easily. Therefore, a key top having enhanced durability and a sensation of metal can be produced at a low cost. Furthermore, the electroless plating layer can previously form a letter, a symbol, or the like that may become a display portion or the like; therefore, it is not required to conduct a laser treatment in a later process. Furthermore, electroplating can plate Cr (chromium) and Au (gold), which are difficult to be attached by electroless plating. Therefore, a key top for a pushbutton switch having enhanced wear resistance and strength and a key top for a pushbutton switch rich in design variation can be obtained.

According to the present invention, a method of producing a key top for a pushbutton switch, in which a polymer coating layer is further formed on the surface of the electroless plating layer or the electroplating layer is provided.

When the polymer coating layer is provided on the surface of the electroless plating layer or the electroplating layer, these plating layers are protected by the polymer coating layer. Therefore, a key top for a pushbutton switch having enhanced wear resistance can be produced. Furthermore, the plating layer can be easily coated with the polymer coating layer, using a colored transparent liquid resin. Thus, a key top for a pushbutton switch having coloring that cannot be obtained only with the plating layer and having an improved design can be produced at a low cost.

Furthermore, according to the present invention, a method of producing a key top for a pushbutton switch including the step of forming a base layer and further a polymer coating layer on a resin film to be a part of a key top body to curve the resin film is provided.

According to the above production method, the base layer and the polymer coating layer are formed on the flat resin film, so that it becomes easy to apply these layers. In particular, even when the base layer or the polymer coating layer are previously applied so as to have a shape such as a letter and a pattern or a complicated design, they are printed onto the flat resin film. Therefore, a key top for a pushbutton switch being having an improved design can be easily produced.

Furthermore, according to the present invention, a method of producing a key top for a pushbutton switch, in which the base layer has a transmittance of visible light of in the range from 3% to 95% is provided.

When the base layer having the transmittance of visible light from 3% to 95% is formed, light is hardly blocked by the base layer. Thus, a key top for a pushbutton switch that may be illuminated can be obtained, in which light transmitted through the base layer illuminates the key top.

According to the present invention, a method of producing a key top for a pushbutton switch, in which an electroless plating layer has a transmittance of visible light in the range from 0.1% to 80% is provided.

When the electroless plating layer having the transmittance of visible light from 0.1% to 80% is formed, light is hardly blocked by the electroless plating layer. Thus, a key top for a pushbutton switch that may be illuminated can be obtained, in which light transmitted through the electroless plating layer. Furthermore, by varying the transmittance of visible light, the color of a metal texture can be changed, and thus, a key top for a pushbutton switch rich in design can be produced.

According to the present invention, a method of producing a key top for a pushbutton switch, in which the key top body is made of a transparent resin, and the base layer has a transmittance of visible light in the range from 3% to 95% is provided.

When the key top body is made of the transparent resin and the base layer has a transmittance of visible light from 3% to 95%, a key top for a pushbutton switch that may be illuminated can be obtained.

The contents of the present invention are not limited to the above-mentioned description. The object, advantage, feature, and use of the present invention will become apparent to those skilled in the art upon reading and understanding the following detailed description with reference to the accompanying figures. It should be understood that various appropriate modifications without departing from the scope and spirit of this invention are contained in the scope of the invention.

DETAILED DESCRIPTION OF THE INVENTION

Hereinafter, the present invention will be described by way of illustrative embodiment modes with reference to the drawings.

1. Configuration

Figure 1A:
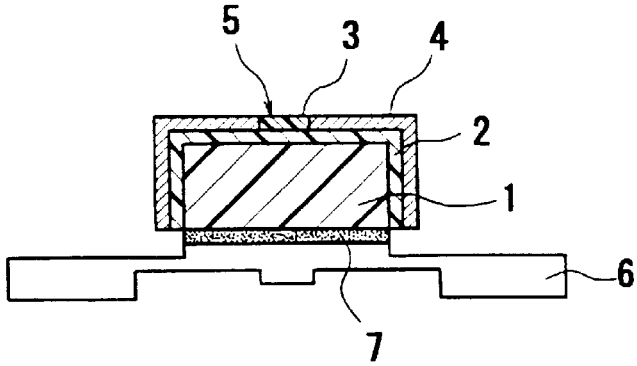
FIG. 1A is a vertical cross-sectional view of a key top for a pushbutton switch in which a display portion is formed of a polymer coating layer in Embodiment Mode 1 according to the present invention.
Figure 1B:
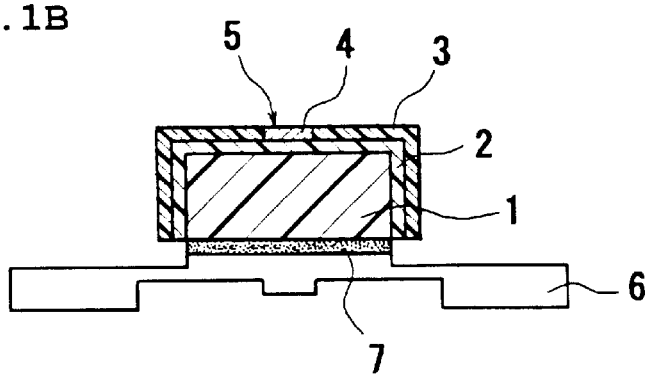
FIG. 1B is a vertical cross-sectional view of the key top for a pushbutton switch in which the display portion is formed of an electroless plating layer in Embodiment Mode 1 according to the present invention.
Figure 1C:
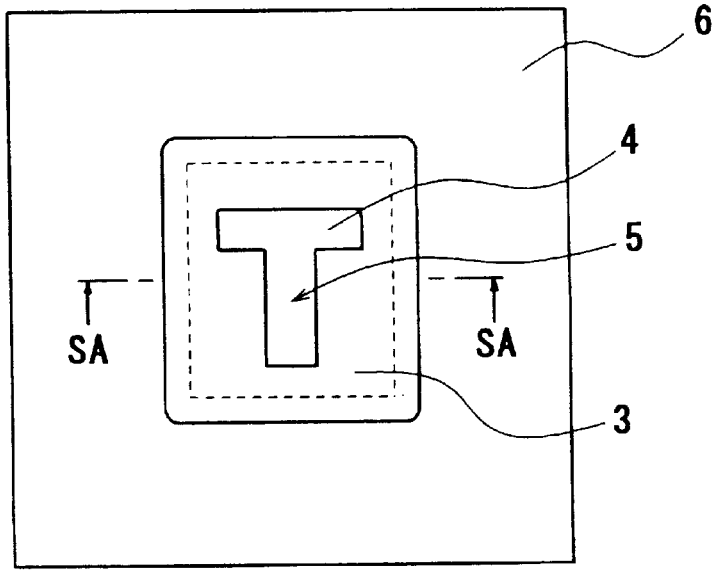
FIG. 1C is a plan view of FIG. 1B.

FIGS. 1A and 1B show a configuration of a key top for a pushbutton switch of Embodiment Mode 1 according to the present invention. A base layer 2 made of an insulating resin to be plated with metal is formed on the surface of a key top body 1 made of a transparent resin. Furthermore, a polymer coating layer 3 is formed on a part of the surface of the base layer 2. An electroless plating layer 4 is formed on the surface of the base layer 2 where the polymer coating layer 3 is not formed. In the present embodiment mode, the polymer coating layer 3 may form a display portion 5 for displaying a letter, a symbol, or the like (FIG. 1A), or the electroless plating layer 4 may form the display portion 5 (FIG. 1B). In the case where the electroless plating layer 4 forms the display portion 5, for example, a letter "T" is displayed by the electroless plating layer 4, as shown in FIG. 1C, and the polymer coating layer 3 forms a region on the periphery of the letter "T". FIG. 1B is a cross-sectional view taken along a line SA—SA in FIG. 1C.

Figure 3A:
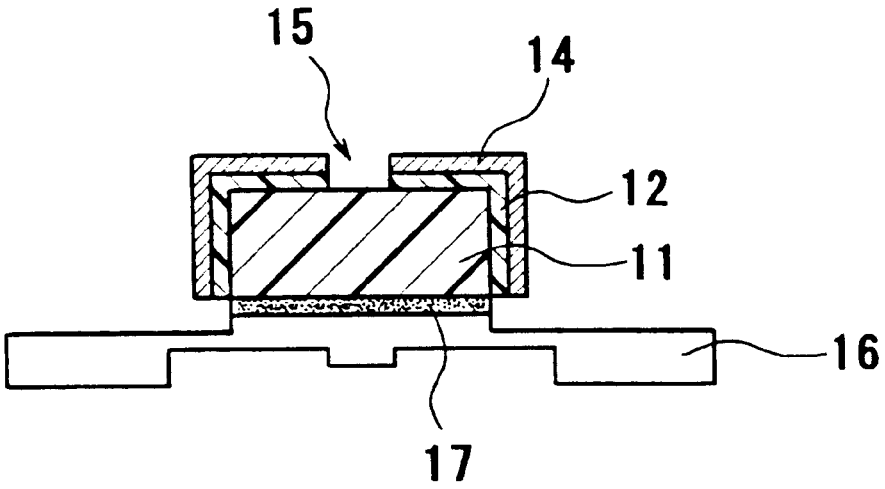
FIG. 3A is a vertical cross-sectional view of a key top for a pushbutton switch in which the key top body forms the display portion in Embodiment Mode 2 according to the present invention.
Figure 3B:
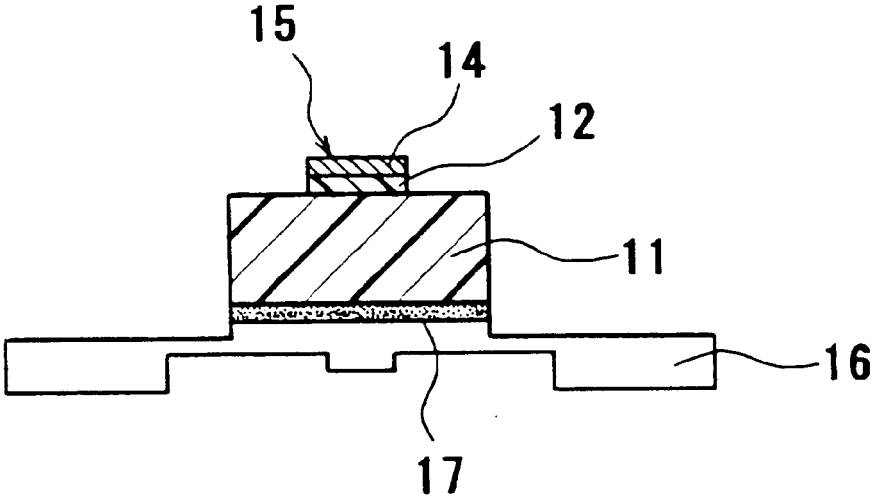
FIG. 3B is a vertical cross-sectional view of the key top for a pushbutton switch in which the electroless plating layer forms the display portion in Embodiment Mode 2 according to the present invention.

FIGS. 3A and 3B show a configuration of a key top for a pushbutton switch of Embodiment Mode 2 according to the present invention. A base layer 12 is formed on the surface of a key top body 11 made of a transparent resin. Furthermore, an electroless plating layer 14 is formed on the surface of the base layer 12. In Embodiment Mode 2, the electroless plating layer 14 is also provided on the surface of the key top body 11 where the base layer 12 is provided. The polymer coating layer in Embodiment Mode 1 is not provided. In Embodiment Mode 2, a display portion 15 may be formed of a region where the electroless plating layer 14 is not formed and the surface of the key top body 11 is directly recognized visually (FIG. 3A), or the display portion 15 may be formed of the electroless plating layer 14 (FIG. 3B).

As a modified example of Embodiment Mode 2, an electroplating layer (not shown) can be formed on the electroless plating layer 14. Furthermore, a polymer coating layer (not shown) can be provided on a partial or entire surface of the electroless plating layer 14. If the electroplating layer is stacked, lustrousness and wear resistance are enhanced. If the polymer coating layer is provided adjacent to a plating layer such as the electroless plating layer 14 or the electroplating layer, at least the ends of these plating layers can be protected. Furthermore, if the polymer coating layer is stacked on the plating layer to cover it, the entire plating layer can be protected. Because of this, the wear resistance of the plating layer that is likely to wear out and peel off is enhanced. If the polymer coating layer is made of a colored transparent layer, a key top for a pushbutton switch an improved design and enhanced wear resistance can be obtained.

Figure 4A:
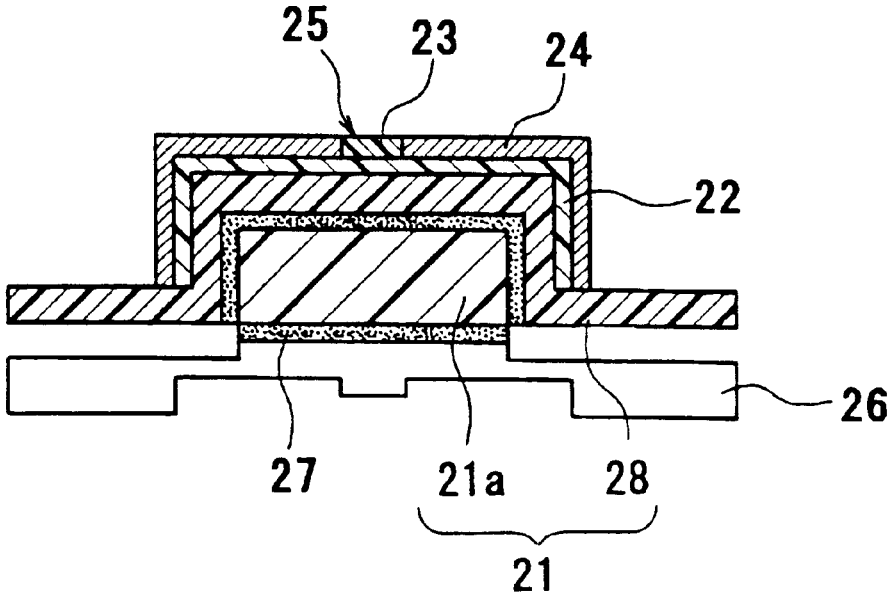
FIG. 4A is a vertical cross-sectional view of a key top for a pushbutton switch in which the polymer coating layer forms the display portion in Embodiment Mode 3 according to the present invention.
Figure 4B:
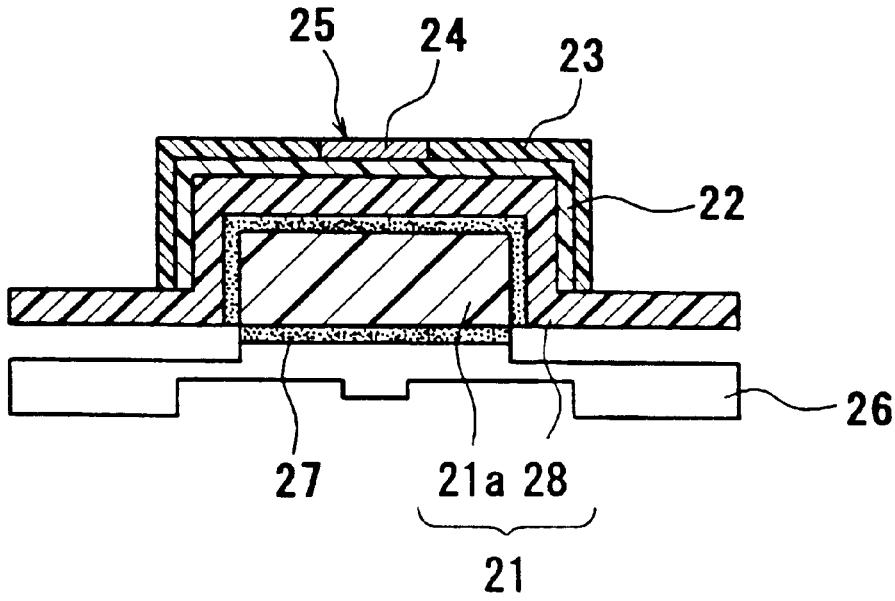
FIG. 4B is a vertical cross-sectional view of the key top for a pushbutton switch in which the electroless plating layer forms the display portion in Embodiment Mode 3 according to the present invention.

FIGS. 4A and 4B show a configuration of a key top for a pushbutton switch of Embodiment Mode 3 according to the present invention. A key top body 21 of Embodiment Mode 3 comprises a resin base 21*a* forming a skeleton of the key top body 21 and a resin film 28 that are integrated with each other. A base layer 22 made of an insulating resin that can be plated with metal is formed on the surface of the resin film 28. A polymer coating layer 23 is further formed on a part of the surface of the base layer 22. Then, an electroless plating layer 24 is formed on the surface of the base layer 22 where the polymer coating layer 23 is not formed. In Embodiment Mode 3, the polymer coating layer 23 may form a display portion 25 for displaying a letter, a symbol, or the like (FIG. 4A), or the electroless plating layer 24 may form the display portion 25 (FIG. 4B).

Figure 7A:
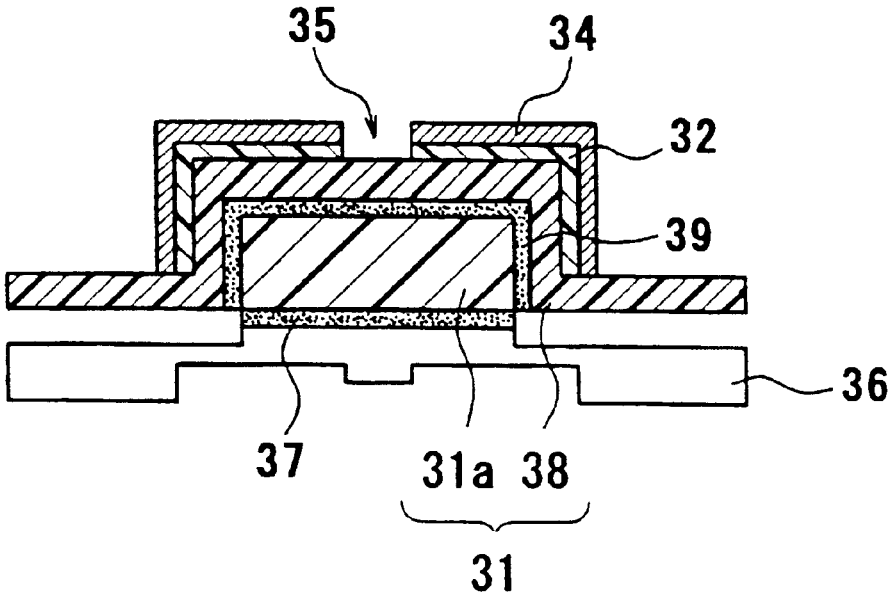
FIG. 7A is a vertical cross-sectional view of a key top for a pushbutton switch in which the key top body forms the display portion in Embodiment Mode 4 according to the present invention.
Figure 7B:
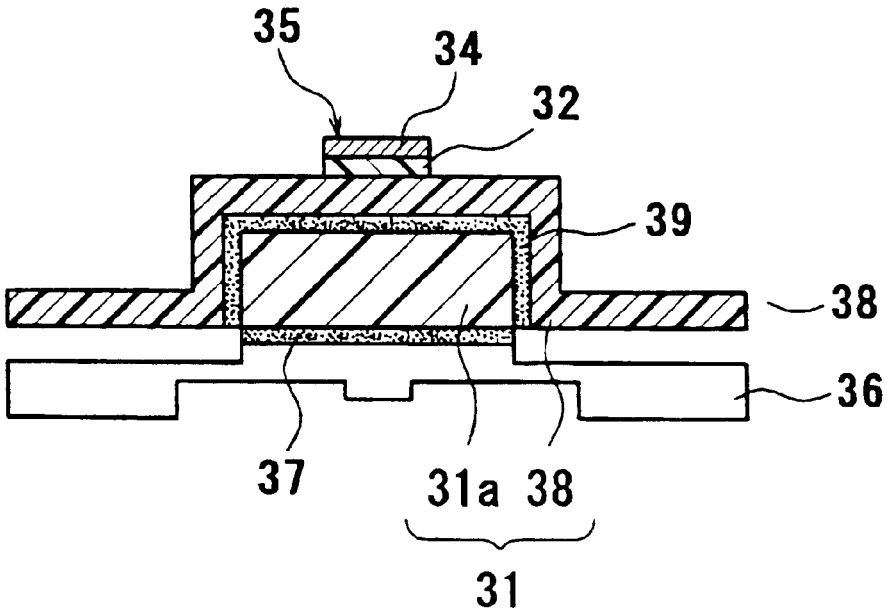
FIG. 7B is a vertical cross-sectional view of the key top for a pushbutton switch in which the electroless plating layer forms the display portion in Embodiment Mode 4 according to the present invention.

FIGS. 7A and 7B show a configuration of a key top for a pushbutton switch of Embodiment Mode 4 according to the present invention. A base layer 32 is formed on the surface of a resin film 38 of a key top body 31 comprising a resin base 31*a* and the resin film 38 that are integrated with each other. An electroless plating layer 34 is formed on the surface of the base layer 32. In Embodiment Mode 4, the electroless plating layer 34 is formed on the surface of the resin film 38 where the base layer 32 is provided. Furthermore, the polymer coating layer 23 in Embodiment Mode 3 is not provided. In Embodiment Mode 4, a display portion 35 may be formed of a region where the electroless plating layer 34 is not formed, and the surface of the resin film 38 is directly recognized visually (FIG. 7A), or the display portion 35 may be formed of the electroless plating layer 34 (FIG. 7B).

As a modified example of Embodiment Mode 4, an electroplating layer (not shown) can be further formed on the electroless plating layer 34. Furthermore, a polymer coating layer (not shown) can be provided on a partial or entire surface of the electroless plating layer 34. If the electroplating layer is stacked, lustrousness and wear resistance are enhanced. If the polymer coating layer is provided adjacent to a plating layer such as the electroless plating layer 34 or the electroplating layer, at least the ends of these plating layers can be protected. Furthermore, if the polymer coating layer is stacked on the plating layer to cover it, the entire plating layer can be protected. Because of this, the wear resistance of the plating layer that is likely to wear out and peel off is enhanced. If the polymer coating layer is made of a colored transparent layer, a key top for a pushbutton switch having an improved design and enhanced wear resistance can be obtained.

Figure 8:
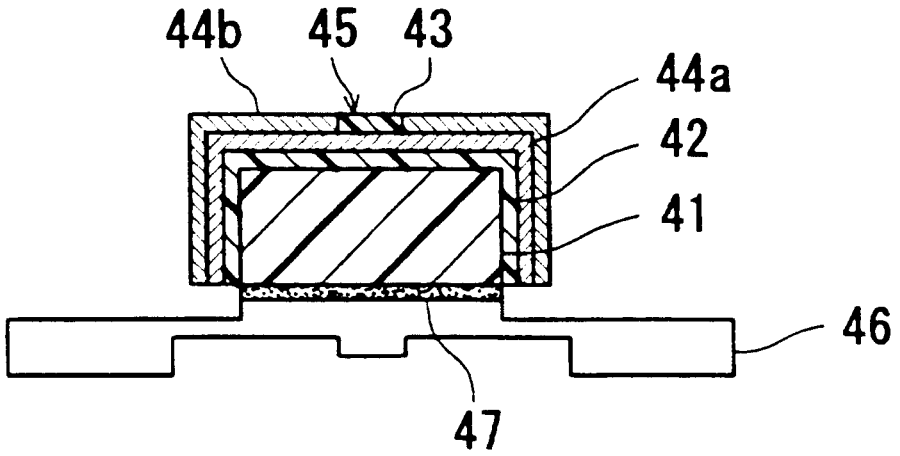
FIG. 8 is a vertical cross-sectional view of a key top for a pushbutton switch in Embodiment Mode 5 according to the present invention.

FIG. 8 shows a configuration of a key top for a pushbutton switch of Embodiment Mode 5 according to the present invention. A base layer 42 made of an insulating resin that can be plated with metal is formed on the surface of a key top body 41 made of a transparent resin. Furthermore, an electroless plating layer 44*a* is formed on the surface of the base layer 42. A polymer coating layer 43 is also formed on a part of the electroless plating layer 44*a*. An electroplating layer 44*b* is formed on the surface of the electroless plating layer 44*a* where the polymer coating layer 43 is not applied. In Embodiment Mode 5, as shown in FIG. 8, the polymer coating layer 43 may form a display portion 45 for displaying a letter, a symbol, or the like. Alternatively, the polymer coating layer 43 may be applied to the electroless plating layer 44*a* in the shape of a pulled-out letter, and the electroplating layer 44*b* may form the display portion 45.

Figure 9:
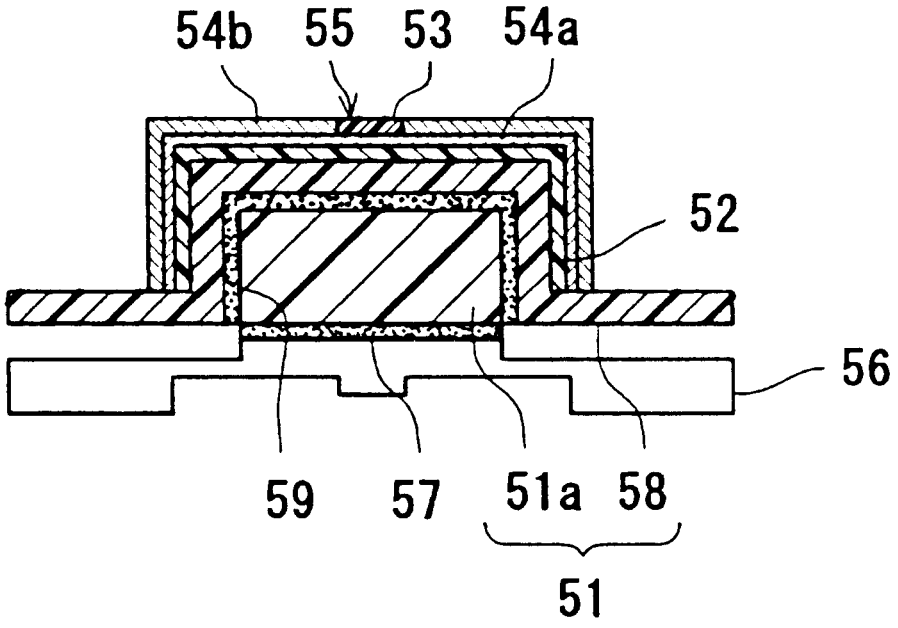
FIG. 9 is a vertical cross-sectional view of a key top for a pushbutton switch in Embodiment Mode 6 according to the present invention.

FIG. 9 shows a configuration of a key top for a pushbutton switch of Embodiment Mode 6 according to the present invention. A key top body 51 in Embodiment Mode 6 comprises a resin base 51*a* and a resin film 58 that are integrated with each other. A base layer 52 made of an insulating resin that can be plated with metal is formed on the surface of a resin film 58. An electroless plating layer 54*a* is formed on the surface of the base layer 52. Then, a polymer coating layer 53 is formed on a part of the electroless plating layer 54*a*, and an electroplating layer 54*b* is formed on the surface of the electroless plating layer 54*a* where the polymer coating layer 53 is not formed. In Embodiment Mode 6, as shown in FIG. 9, the polymer coating layer 53 may form a display portion 55 for displaying a letter, a symbol, or the like. Alternatively, the polymer coating layer 53 may be applied to the electroless plating layer 54*a* in the shape of a pulled-out letter, and the electroplating layer 54*b* may form the display portion 55.

2. Constituent Portion and Production Method

Hereinafter, each portion constituting the key top for a pushbutton switch of the present invention will be described.

2-1. Constituent Portion and Production Method in Embodiment Mode 1

First, each portion constituting the key top for a pushbutton switch of Embodiment Mode 1 according to the present invention will be described with reference to FIGS. 1A–1C. The key top for a pushbutton switch of Embodiment Mode 1 includes the key top body 1, the base layer 2, the polymer coating layer 3, and the electroless plating layer 4, and the display portion 5 is formed on an upper surface of the key top.

It should be noted that the key top for a pushbutton switch is attached to a keypad 6 via an adhesive layer 7 to form a keypad with a key top for a pushbutton switch.

1. Description of the Key Top Body 1:

The key top body 1 can be made of a resin generally used for a key top for a pushbutton switch. In particular, a thermoplastic resin, a thermosetting resin, and a light-curable resin, which cannot be plated by electroless plating, can also be used. Examples of these resins include polymethyl methacrylate (PMMA) resins, polystyrene (PS) resins, acrylonitrile/styene copolymer (AS) resins, methyl methacrylate/styrene copolymer (MS) resins, polycarbonate (PC) resins, polyethylene (PE) resins, crystalline polyolefin resins, polycyclic norbornene methacrylate resins, epoxy resins.

The resin used for the key top body 1 is not limited to a transparent resin. However, in the case where the keypad 6 is illuminated, the key top body 1 is preferably made of a transparent resin. Herein, a transparent resin refers to a resin with a transmittance of visible light of at least 0.1%.

The key top body 1 is formed to a desired shape by molding the above-mentioned resin by a general method (e.g., injection molding).

2. Description of the Base Layer 2:

The base layer 2 is formed on the surface of the key top body 1 so as to function as a base for attaching metal to the key top body 1. More specifically, the base layer 2 is a layer interposed between the electroless plating layer 4 and the key top body 1. In other words, the base layer 2 is a layer made of an insulating resin to be plated with metal by electroless plating.

Examples of the insulating resin constituting the base layer 2 include: resins such as acrylonitrile/butadiene/styrene (ABS) resins, polypropylene (PP) resins, polyphenylene oxide (PPO) resins, polyacetal (POM) resins, polyamide resins, and polysulfon resins; alloy resins thereof; alloy resins of polycarbonate (PC) resins; and modified resins thereof.

The base layer 2 may be colorless or colored. In the case where the polymer coating layer 3 is formed on the surface of the base layer 2, which is not provided with the electroless plating layer 4, and the polymer coating layer 3 is illuminated as the display portion 5, the base layer 2 is preferably transparent.

In the case of producing a key top that may be illuminated, it is preferable that the base layer 2 has a transmittance of visible light of at least 3%. When the transmittance of visible light of the base layer 2 is less than 3%, visible light is hardly transmitted through the base layer 2, and sufficient brightness may not be obtained.

The thickness of the base layer 2 is in the range from 3 $\mu$m to 100 $\mu$m, and more preferably from 5 $\mu$m to 15 $\mu$m. When the thickness of the base layer 2 is less than 3 $\mu$m, it is difficult to form an uneven surface of the base layer 2, which provides an anchor effect during etching, and to maintain adhesion (coating property) of the electroless plating layer 4. Thus, it is preferable that the thickness is 5 $\mu$m or more in terms of further adhesion. It should also be noted that forming the base layer 2 having a thickness greater than 15 $\mu$m is not economical. Furthermore, in order to provide sufficient illumination in the case of the key top that may be illuminated, it is preferable that the thickness of the base layer 2 does not exceed 15 $\mu$m. However, it is also possible to prescribe the thickness of the base layer 2 to be more than 15 $\mu$m as in the case of keeping a color concentration of the base layer 2 with color transparency containing a colorant. Even in such a case, it is preferable that the thickness is equal to or less than 100 $\mu$m in view of an economic aspect.

Since the thickness of the base layer 2 is required to be 3 $\mu$m or more, the transmittance of visible light of the base layer 2 cannot exceed that in the case where the thickness of the base layer 2 is set to be 3 $\mu$m. For example, if the base layer 2 is formed of a liquid resin that allows the transmittance of visible light to be 95% in the case where the thickness of the base layer 2 is 3 $\mu$m, the transmittance of visible light of the base layer 2 becomes 95% or less.

In order to obtain the base layer 2, a liquid resin is applied to the surface of the key top body 1. As a coating method, a general procedure for providing a resin layer on the surface of the key top body 1, i.e., printing, painting, dipping, or the like can be adopted. For example, screen printing or the like can be used.

The liquid resin is obtained by dissolving a resin constituting the base layer 2 in an appropriate organic solvent selected from the group consisting of cyclohexanone, toluene, isophorone, xylene, ethyl acetate, isobutyl acetate, diethylene acetate glycol monoethyl ether, diethylene acetate glycol monobutyl ether, and the like; or an organic solvent of a mixture thereof. The content of an organic solvent in the liquid resin and the viscosity of the liquid resin are determined in a range that does not cause any problem in flowability and leveling property of the liquid resin, operability such as printing and painting, and the like. By adding a small amount of a leveling agent, such as a silicone base, a modified silicone base, a fluorine base, or the like, to the liquid resin, the leveling property of the liquid resin can be enhanced, and the surface of the base layer 2 can be made reasonably smooth.

3. Description of the Polymer Coating Layer 3:

The polymer coating layer 3 is provided in a region on the base layer 2 where the electroless plating layer 4 is not provided, and is not plated with metal during plating. The polymer coating layer 3 is deposited on the surface of the key top to protect the electroless plating layer 4. The polymer coating layer 3 functions as a masking layer for forming the electroless plating layer 4.

A resin constituting the polymer coating layer 3 is appropriately selected from the group consisting of polycarbonate (PC) resins, acrylic resins, vinyl acetate resins, vinyl chloride resins, urethane resins, polyester resins, epoxy resins, and the like. The resin is required to form a resin layer that cannot be plated with metal by electroless plating. However, the resin is required to adhere to the base layer 2 and have increased wear resistance during the plating process.

The polymer coating layer 3 is prepared as an ink containing the above-mentioned resin as a main component, and applied to the surface of the base layer 2 by pad printing, screen printing, gravure printing, or the like. Since the polymer coating layer 3 may form the display portion 5, a polymer coating ink containing the above-mentioned resin may be colorless or colored, and may contain a colorant, such as a pigment. If the polymer coating layer 3 with transparency, colored with a pigment or the like, is prepared, the base layer 2 as well as the key top body 1 can be made transparent, whereby the polymer coating layer 3 can be illuminated. Consequently, a key top excellent in design can be obtained.

The thickness of the polymer coating layer 3 can be appropriately selected. In general, the thickness of the polymer coating layer 3 is set to be substantially equal to that of the electroless plating layer 4 formed adjacent to the polymer coating layer 3. Alternatively, it is also possible to provide an uneven key top so as to realize the touch like an embossed letter.

4. Description of the Electroless Plating Layer 4:

The electroless plating layer 4 gives a sensation of metal to a key top, so that it is deposited on the surface of the key top body 1 via the base layer 2. In general, a region corresponding to a letter, a symbol, or the like is formed of the electroless plating layer 4 to provide the display portion 5 (FIG. 1B). However, it may also be possible that a region other than that corresponding to a letter, a symbol, or the like is formed of the electroless plating layer 4, whereby the display portion 5 is formed like a pulled-out letter (FIG. 1A).

The electroless plating layer 4 is formed by attaching a metal film to the base layer 2 made of an insulating resin by electroless plating.

As metal constituting the electroless plating layer 4 formed by electroless plating, all the metal used by general electroless plating can be used. For example, nickel, copper, and the like can be used.

The thickness of the electroless plating layer 4 is preferably in the range from 0.1 $\mu$m to 50 $\mu$m. In the case where the thickness of the electroless plating layer 4 is less than 0.1 $\mu$m, wear resistance and strength are insufficient, which is not preferable. Furthermore, when the thickness of the electroless plating layer 4 is larger than 50 $\mu$m, although strength and the like are sufficient, it is not economical. Therefore, this case is not preferable, either.

Prior to plating, the surface of the base layer 2 can be etched as a pre-treatment so that the contact strength of the electroless plating layer 4 is enhanced. The etching treatment is conducted, for example, as follows. First, as a pre-treatment, the surface of the base layer 2 is defatted. Then, the resultant base layer 2 is soaked in an etchant containing chromic acid (400 g/l) and sulfuric acid (200 ml/l) at 70° C. for 2.5 minutes, whereby an etching treatment is conducted. After neutralization and removal of remaining chromic acid, a catalyst treatment and an accelerator treatment are conducted. In the catalyst treatment, a Sn (tin)/Pd (palladium) complex salt catalyst is adsorbed to the etching surface. In the accelerator treatment, adsorbing Sn (tin) is removed to activate Pd (palladium). Then, the surface after the etching treatment is subjected to electroless plating, whereby the electroless plating layer 4 is formed. In this case, for example, Ni electroless plating (thickness: 3 $\mu$m) is formed.

In the electroless plating method, metal is precipitated with a reducing agent. Therefore, it is possible to plate a resin that is difficult to be-plated by electroplating. It is also possible to vary the film thickness arbitrarily according to this method.

Figure 2A:
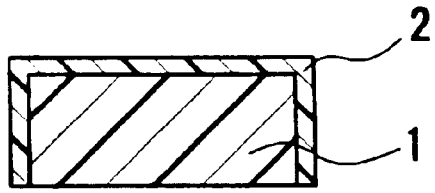
FIGS. 2A to 2C are vertical cross-sectional views of a key top for a pushbutton switch, showing the processes of producing the key top for a pushbutton switch in Embodiment Mode 1 according to the present invention.
Figure 2B:
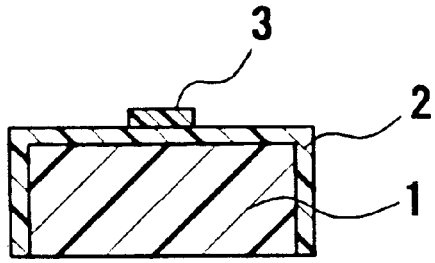
Figure 2C:
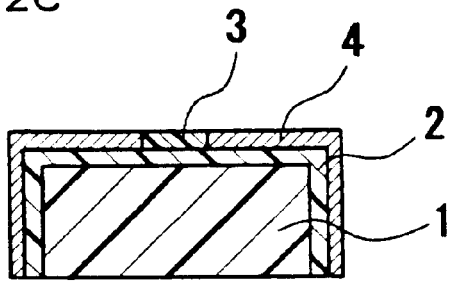

5. Description of the Production Method:

A key top for a pushbutton switch of Embodiment Mode 1 according to the present invention is produced as follows. The key top body 1 made of a transparent resin and molded in a predetermined shape is coated with a liquid resin, whereby the base layer 2 with insulation to be plated with metal is formed (FIG. 2A). Thereafter, a colorless or colored polymer coating ink is applied to a desired position of the base layer 2, whereby the polymer coating layer 3 that is not plated with metal is formed on a part of the surface of the base layer 2 (FIG. 2B). Then, the electroless plating layer 4 is formed on the surface of the base layer 2 by electroless plating where the polymer coating layer 3 is not formed (FIG. 2C). Because of this, a key top for a pushbutton switch is obtained, in which the polymer coating layer 3 is formed in the shape of a pulled-out letter with respect to the electroless plating layer 4 to display a letter, a symbol, or the like, thereby constituting the display portion 5. In this key top for a pushbutton switch, the electroless plating layer 4 is formed by being masked with the polymer coating layer 3. Therefore, even letters having an island portion, such as digits "9" and "0" can be easily formed at a key top portion. In order to produce a keypad with a key top, the bottom surface of the key top body 1 is fixedly attached to the keypad 6 via the adhesive layer 7, as shown in FIG. 1.

2—2. Constituent Portion and Production Method in the Other Embodiment Modes

A material for each portion constituting the key top for a pushbutton switch of Embodiment Mode 2 (FIGS. 3A and 3B) is the same as that in Embodiment Mode 1, except that the polymer coating layer 13 is not present.

The key top for a pushbutton switch of Embodiment Mode 2 can be produced by the same method as described in Embodiment Mode 1. However, during coating of a base layer ink, the base layer 12 is applied in the shape of a letter, a symbol, or the like to form the display portion 15 (FIG.

3B). Alternatively, the peripheral portion of the shape of a letter, a symbol, or the like is applied to form the display portion 15 in a pulled-out letter (FIG. 3A). Therefore, it is required to conduct exact coating to a predetermined place on the surface of the key top body 11. In the key top for a pushbutton switch of the present embodiment mode, since the base layer 12 is previously provided so that it corresponds to a display portion, even letters having an island portion, such as digits "9" and "0", can be easily formed.

Each constituent portion of the key top for a pushbutton switch of Embodiment Mode 3 (FIGS. 4A and 4B) is the same as that in Embodiment Mode 1, except for the configuration of the key top body 21. The key top body 21 of Embodiment Mode 3 comprises the resin base 21*a* forming a skeleton of the key top body 21 and the resin film 28 that are integrated with each other, whereby the key top body 21 is provided with the resin film 28 on its surface.

The resin film 28 is a part of the key top body 21, and made of a resin film which is positioned on the surface of the key top body 21. For the resin film 28, a general resin film that can be integrated with the key top body 21 can be used. A thermoplastic resin film that is not plated with metal can also be used. Examples of the resin film include: a polyethylene-based film such as a polyethylene terephthalate film, a polycarbonate film, and the like. In the case where the keypad 26 is illuminated, it is preferable to use one of the above-mentioned resin films that is substantially transparent.

Figure 5A:
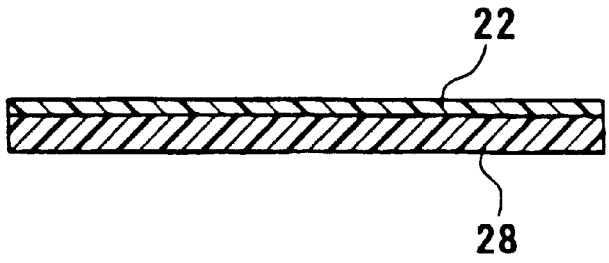
FIGS. 5A to 5C are vertical cross-sectional views of a key top for a pushbutton switch, showing the first half of the processes of producing the key top for a pushbutton switch in Embodiment Mode 3 according to the present invention.
Figure 5B:
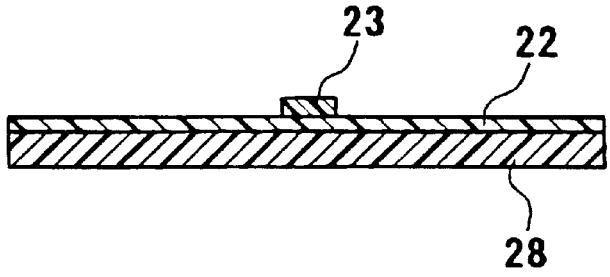
Figure 5C:
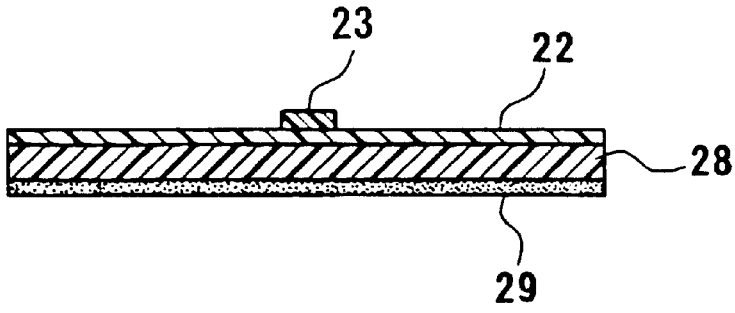
Figure 6A:
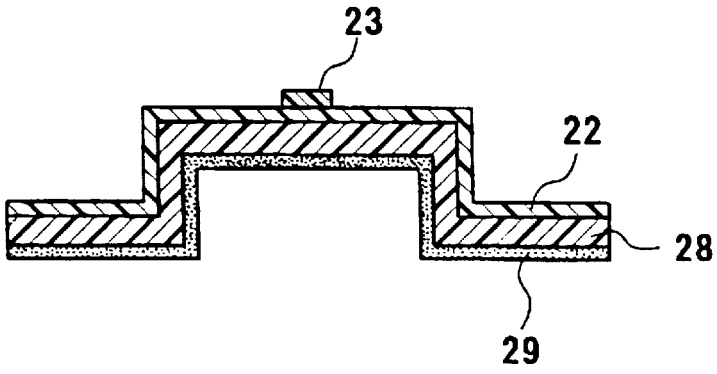
FIGS. 6A to 6C are vertical cross-sectional views of a key top for a pushbutton switch, showing the second half of the processes of producing the key top for a pushbutton switch in Embodiment Mode 3 according to the present invention.
Figure 6B:
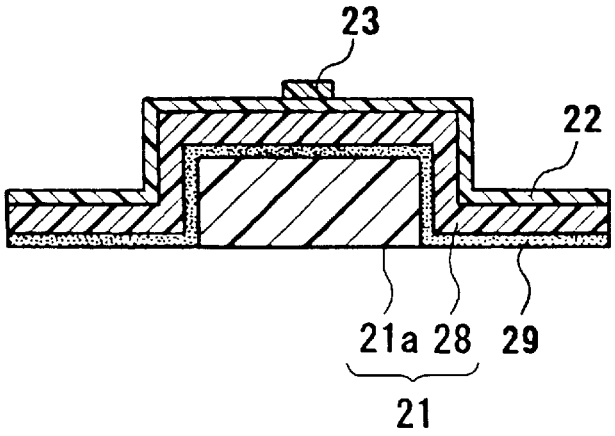
Figure 6C:
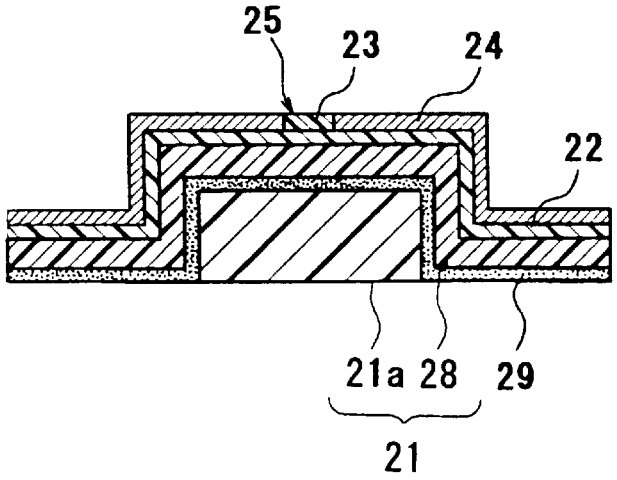

The key top for a pushbutton switch of Embodiment Mode 3 is produced as follows. The surface of the resin film 28 is coated with a liquid resin (material for the base layer 22) that is to be plated with metal, whereby the base layer 22 which has insulating property is formed (FIG. 5A). Then, a polymer coating ink is applied to a desired position of the base layer 22, whereby the colorless or colored polymer coating layer 23 that is not plated with metal is formed on a part of the base layer 22 (FIG. 5B). Then, the colorless or colored adhesive layer 29 is formed on the reverse surface of the resin film 28 (FIG. 5C), and the resultant stack is curved with a die (FIG. 6A). Then, a melted resin forming the resin base 21*a* is injected into the curved convex portion and cured, whereby the key top body 21 integrated with the resin film 28 is obtained (FIG. 6B). Then, the electroless plating layer 24 is formed on the surface of the base layer 22 by electroless plating where the polymer coating layer 23 is not formed (FIG. 6C). Thereafter, the electroless plating layer 24, the base layer 22, and the adhesive layer 29 provided in a brim portion of the substantially hat-shaped key top are removed. Because of this, a key top for a pushbutton switch is obtained, in which the portion of the polymer coating layer 23 forms the display portion 25 for displaying a letter or a symbol. In order to produce a keypad with a key top, the bottom surface of the key top body 21 is attached to the keypad 26 via the adhesive layer 27, as shown in FIG. 4A.

In the present embodiment mode, a resin film is formed in a curved shape, and the convex portion thereof is filled with a resin to produce the key top body 21. However, a key top body may also be produced by integrating a resin film with a resin base previously formed into the shape of a key top. Furthermore, instead of forming the base layer 22, and the electroless plating layer 24 over the entire resin film 28, and then removing unnecessary portions of the base layer 22 and the electroless plating layer 24, the process of removing unnecessary portions may be omitted by previously forming the base layer 22 and the electroless plating layer 24 only on a portion requiring the electroless plating layer 24. Furthermore, the adhesive layer 29 may be applied to only a portion corresponding to the convex portion when the resin film is curved.

A material and a production method of a key top for a pushbutton switch of Embodiment Mode 4 (FIGS. 7A and 7B) may also be similar to those described in Embodiment Modes 2 and 3. However, during coating of the base layer ink, the base layer 32 is applied in the shape of a letter, a symbol, or the like, to form the display portion 35 (FIG. 7B), or is applied on the peripheral portion of the shape of a letter, a symbol, or the like, to form the display portion 35 in the shape of a pulled-out letter (FIG. 7A). Therefore, it is required to conduct exact coating to a predetermined position on the surface of the key top body 31.

As a material for each portion constituting the key top for a pushbutton switch of Embodiment Mode 5 (FIG. 8) and a method of producing the key top for a pushbutton switch, the material and production method described in Embodiment Mode 1 can be adopted. However, a layer configuration of the key top for a pushbutton switch is different, so that different portions will be described.

In the description of Embodiment Mode 5, the electroless plating layer 44*a* is provided on the base layer 42, and a portion of the electroless plating layer 44*a* is coated with the polymer coating layer 43. Furthermore, on the surface of the electroless plating layer 44*a* where the polymer coating layer 43 is not provided, the electroplating layer 44*b* is stacked. The reason for stacking the electroplating layer 44*b* is that the electroplating layer 44*b* has desirable properties—e.g., wear resistance and lustrousness—compared to the electroless plating layer 44*a*. Because there is some difficulty in depositing chromium (Cr) by electroless plating, Cr is preferably plated by electroplating. By forming the outermost surface of a key top of a Cr surface, a key top for a pushbutton switch having enhanced wear resistance and lustrousness can be obtained.

The electroless plating layer 44*a* is generally formed over the entire surface of the base layer 42. This is because, even if the electroless plating layer 44*a* is formed as a thin film, it sufficiently functions as a base of the electroplating layer 44*b* to be stacked, and its transparency does not become poor. Therefore, even if the electroless plating layer 44*a* is provided as a thin film over the entire surface of the base layer 42, there is no problem in cost. Thus, the thickness of the electroless plating layer 44*a* can be set to be 0.1 $\mu$m to 50 $\mu$m in the same way as in Embodiment Mode 1. Herein, the electroless plating layer 44*a* may function as a base for stacking the electroplating layers 44*b*, so that the thickness of the electroless plating layer 44*a* should be set so that electroplating is appropriately conducted. Particularly, in order to make the electroless plating layer 44*a* transparent, the thickness thereof is preferably in the range from 1 nm to 200 nm, and more preferably from 30 nm to 100 nm. When the thickness of the electroless plating layer 44*a* is smaller than 1 nm, the electroless plating layer 44*a* may be eluted in electroplating liquid. Alternatively, the resistance of the electroplating layer becomes substantially high, thereby making the electroless plating layer inappropriate as a base for the electroplating layer. When the thickness is larger than 200 nm, the transparency of the electroless plating layer is almost eliminated, and the resultant key top cannot be illuminated. Therefore, a key top having an improved design cannot be obtained. The reason why the thickness of the electroless plating layer 44*a* is preferably 30 nm to 100 nm is as follows: when the thickness is smaller than 30 nm, a uniform electroplating layer is unlikely to be formed, and when the thickness is larger than 100 nm, the transmittance of visible light is decreased below 3%, thereby resulting in poor transmittance.

The reason for making the electroless plating layer 44*a* transparent is as follows: when the keypad 46 side (reverse side of the key top) is illuminated, light is transmitted through the key top, and transmitted light is visually recognized. The transmittance of visible light in the case of making the electroless plating layer 44*a* transparent is 80% or less. More specifically, the thickness of the electroless plating layer 44*a* is preferably at least 1 nm. Therefore, the transmittance of visible light cannot exceed 80% when the thickness of the electroless plating layer 44*a* is 1 nm.

Regarding a range of the thickness of the electroless plating layer 44*a* that is reasonably transparent, for example, when the thickness of the electroless plating layer 44*a* is about 80 nm, a sensation of metal is obtained. In contrast, when the thickness is smaller than 30 nm, a sensation of metal is eliminated. Therefore, it is possible to change the design of the resulting pushbutton switch by varying the thickness of the electroless plating layer 44*a*, coupled with varying the color and the transmittance of the polymer coating layer 43 (which is formed on the surface of the electroless plating layer 44*a*).

The electroplating layer 44*b* is formed by attaching a metal film by electroplating onto the electroless plating layer 44*a* as a base. As a metal constituting the electroplating layer 44*b*, a metal used in general electroplating can be used. Examples of metals include nickel (Ni), copper (Cu), chromium (Cr), tin (Sn), cobalt (Co), gold (Au), silver (Ag), lead (Pb), zinc (Zn) and any alloy containing them. The thickness of the electroplating layer 44*b* is in the range from about 1 μm to about 30 μm, and more preferably from 5 μm to 15 μm. When the thickness of the electroplating layer 44*b* is smaller than 5 μm, an electroplating layer with a uniform surface cannot be obtained. When the thickness is larger than 15 μm, there is no substantial difference in appearance, which is uneconomical.

The electroplating layer 44*b* can be provided so that different kinds of metals are stacked. For example, the electroplating layer 44*b* in which Cu, Ni, and Cr are stacked in this order from the keypad 46 side can be formed. By varying the thickness of each metal layer, the order, the kind, and the like, wear resistance and color can be modified.

The liquid resin shown in Embodiment Mode 1 can be used for the polymer coating layer 43. However, in Embodiment Mode 1, adhesion with the base layer 2 is important, whereas in the present embodiment mode, adhesion with the electroless plating layer 44*a* is important.

Each constituent portion of the key top for a pushbutton switch of Embodiment Mode 6 (FIG. 9) is the same as that in the case of Embodiment Mode 5, except for the configuration of the key top body 51. More specifically, in the present embodiment mode, the key top body 51 comprises the resin base 51*a* and the resin film 58 integrated with each other. Resin films that can be used as the resin film 58 are the same as those described in Embodiment Mode 3.

The method of producing a key top for a pushbutton switch of Embodiment Mode 6 can be used by combining the method of Embodiment Mode 3 with the method of Embodiment Mode 5. Furthermore, modified methods of these embodiment modes are also applicable.

EXAMPLES

Hereinafter, the present invention will be described by way of illustrative examples and a reference example. However, the present invention is not limited to the following examples.

Example 1 (FIG. 3B)

ABS resin (3001 MF, trade mark, produced by Mitsubishi Rayon Co., Ltd.) of a plating grade was dissolved in an organic solvent, cyclohexanone (Wako Pure Chemical Industries, Ltd.), whereby ABS resin ink containing 1000 parts by weight of cyclohexanone based on 100 parts by weight of the ABS resin was prepared for forming a base layer.

The above-mentioned ABS resin ink was pad-printed at a desired position on the surface of a key top body 11 made of a polycarbonate (PC) resin molded by injection molding. Thereafter, the organic solvent, cyclohexanone, was completely removed by a dryer at 80° C., whereby a base layer 12 was formed. The base layers 12 with the following thicknesses were formed: 3 μm to 5 μm, 8 μm to 10 μm, 13 μm to 15 μm, and 20 μm to 22 μm.

Next, the surface of the base layer 12 was defatted. Thereafter, the base layer 12 was soaked in an etchant containing chromic acid (400 g/l) and sulfuric acid (200 ml/l) at 70° C. for 2.5 minutes, whereby an etching treatment was conducted. After neutralization and removal of remaining chromic acid, a catalyst treatment and an accelerator treatment were conducted. In the catalyst treatment, Sn (tin)/Pd (palladium) complex salt catalyst was adsorbed to the etching surface. In the accelerator treatment, adsorbing Sn (tin) was removed to activate Pd (palladium).

Then, a nickel electroless plating layer 14 was formed on the surface of the base layer 12 made of ABS resin by electroless plating, whereby a key top for a pushbutton switch in which the electroless plating layer 14 functions as a display portion 15 was produced. The thickness of the nickel electroless plating layer 14 was 3 μm. The key top was attached to a keypad 16 via an adhesive layer 17 to produce a keypad with a key top as shown in FIG. 3B. Among the key tops obtained in the present example, the key top having the base layer with a thickness of 3 μm to 5 μm was represented by Sample 1-1; the key top having the base layer with a thickness of 8 μm to 10 μm was represented by Sample 1-2; the key top having the base layer with a thickness of 13 μm to 15 μm was represented by Sample 1-3; and the key top having the base layer with a thickness of 20 μm to 22 μm was represented by Sample 1-4.

Samples 1-1 to 1-4 in Example 1 are based on the key top for a pushbutton switch of Embodiment Mode 2.

Example 2 (FIG. 4A)

Base layer ink was prepared in the same way as in Example 1, using ABS resin (3001 MF, trade mark, produced by Mitsubishi Rayon Co., Ltd.) of a plating grade. The base layer ink was screen-printed onto the surface of a polyethylene-based resin film 28 to form an insulating base layer 22. The thickness of the base layer 22 was 5 μm. Then, an acrylic-based ink was applied, as a polymer coating ink, to a desired position on the surface of the base layer 22 by pad printing to form a polymer coating layer 23. An adhesive layer 29 was formed on the reverse surface of the resin film 28, using a white urethane-based ink. The resin film 28 was curved with a die, and the curved convex portion was filled with PC resin, whereby a key top body 21 integrated with the resin film 28 was obtained. After an etching treatment, a nickel electroless plating layer 24 was formed by electroless plating on the surface of the base layer 22. The key top was attached to a keypad 26 via an adhesive layer 27 to produce a keypad with a key top as shown in FIG. 4A. The key top obtained in the present example was represented by Sample 2.

Sample 2 in Example 2 is based on the key top for a pushbutton switch of Embodiment Mode 3.

Example 3 (FIG. 8)

First, 100 parts by weight of ABS resin (3001 MF, trade mark, produced by Mitsubishi Rayon Co., Ltd.) of a plating grade was dissolved in 1000 parts by weight of cyclohexanone, and 2 parts by weight of a fluorine type leveling agent (Schwego Flour 8038, produced by Brend Schwegmann) was further mixed in the solution to prepare an ABS resin coating.

The ABS resin coating was applied by spray coating to the surface of a key top body 41 made of PC resin (polycarbonate resin) molded by injection molding. Thereafter, the ABS resin coating was dried by a box drier at 100° C. for 60 minutes to completely remove cyclohexanone, thereby forming a base layer 42 made of ABS resin with a thickness of 8 μm to 10 μm.

The surface of the key top on which the base layer 42 was formed was subjected to an etching treatment, and was coated with a catalyst. Thereafter, a nickel electroless plating layer 44*a* with a thickness of 30 nm was formed. On the surface of the electroless plating layer 44*a*, an acrylic/urethane type-based ink (SG 740, trade mark, produced by Seiko Advance Co., Ltd.) was printed in the shape of a pulled-out letter. The electroless plating layer 44*a* was dried by a box drier at 80° C. for 30 minutes, whereby an insulating polymer coating layer 43 was formed.

Finally, electroplating was conducted to form a chromium electroplating layer 44*b* on the surface of the electroless plating layer 44*a* to obtain a key top. The key top was attached to a keypad 46 via an adhesive layer 47 to produce a keypad with a key top as shown in FIG. 8. This keypad was represented by Sample 3.

Sample 3 in Example 3 is based on the key top for a pushbutton switch of Embodiment Mode 5.

Reference Example (FIG. 3B)

A key top for a pushbutton switch was produced in the same way as in Example 1, except that the thickness of a base layer was set to be 1 μm to 2 μm. This key top was represented by Sample 4.

Sample 4 in Reference Example is based on the key top for a pushbutton switch of Embodiment Mode 2.

Experiment:

Each sample obtained in Examples 1 to 3 and Reference Example was evaluated for illumination and plate adhesion of a plating layer plate adhesion was evaluated by a tape peeling test (JIS K 5600-5-6) by crosscut. Table 1 shows the results.

TABLE 1

| | Example 1 | | | | Example 2 | Example 3 | Reference Example |
|---|---|---|---|---|---|---|---|
| | Sample 1-1 | Sample 1-2 | Sample 1-3 | Sample 1-4 | Sample 2 | Sample 3 | Sample 4 |
| Thickness of a base layer (μm) | 3–5 | 8–10 | 13–15 | 20–22 | 5 | 8–10 | 1–2 |
| Illumination of a base layer | Satisfactory | Satisfactory | Satisfactory | Insufficient | Satisfactory | Satisfactory | Satisfactory |
| Etched state of a base layer | Satisfactory | Satisfactory | Satisfactory | Satisfactory | Satisfactory | Satisfactory | Insufficient |
| Plate adhesion of a plating layer | Satisfactory | Satisfactory | Satisfactory | Satisfactory | Satisfactory | Satisfactory | Insufficient |
| Outer appearance of a plating layer | Satisfactory | Satisfactory | Satisfactory | Satisfactory | Satisfactory | Satisfactory | Unevenness |

There were no defects such as unevenness or contact defects in the plating layers, except for insufficient illumination in Sample 1-4 (Example 1) according to the present invention. In Sample 4 (Reference Example), the base layer is thin, so that the anchor effect due to etching is insufficient, and unevenness occurred in formation of the electroless plating layer. Furthermore, adhesion thereof was insufficient. Thus, the thickness of the base layer is preferably at least 3 μm. Furthermore, Sample 3 (Example 3) in which the electroplating layer was formed had more desirable lustrousness, compared with other samples.

In each sample obtained in Examples 1 to 3, and Reference example, a keypad with a key top having a display portion on a key top panel was obtained, in which even if digits having an island portion such as "9" and "0" are displayed, the island portion is also plated.

INDUSTRIAL APPLICABILITY

According to the present invention, a key top for a pushbutton switch can be obtained which has rich variation in design, color, and the like while using a key top body made of a resin that can be mass-produced at a low cost with enhanced durability.

Furthermore, according to the method of producing a key top for a pushbutton switch of the present invention, minute and complicated designs can be formed easily on a key top portion so that a letter and the like having an island portion is easily formed, while having metal lustrousness, and the plating layer can be made thick to some degree. Therefore, a key top for a pushbutton switch having enhanced durability and an improved design can be obtained. Furthermore, if a key top body comprising a resin base and a resin film that are integrated with each other is used, the surface of the thin resin film can be coated with a base layer or a polymer coating layer, and hence, the base layer and the polymer coating layer can be easily provided. Furthermore, according to the method of providing the polymer coating layer, the polymer coating layer is not plated, so that a layer to be plated and a layer that is not to be plated can be easily formed on the surface of the key top.

What is claimed is:

1. A key top for a pushbuton switch, comprising:

a resin key top body, which is made of a resin that cannot be plated by electroless plating;

a base layer made of an insulating resin that can be plated with metal by electroless plating and formed on a surface of the key top body; and an electroless plating layer formed on a surface of the base layer, wherein the base layer and the electroless plating layer are stacked on the key top body.

2. The key top for a pushbutton switch according to claim 1, further comprising an electroplating layer formed by electroplating on the electroless plating layer.

3. The key top for a pushbutton switch according to claim 2, further comprising a polymer coating layer formed on the surface of the electroplating layer.

4. A key top for a pushbutton switch, comprising:

a resin key top, which is made of a resin that cannot be plated by electroless plating;

a base layer made of an insulating resin that can be plated with metal by electroless plating and formed on a surface of the key top body;

an electroless plating layer formed on a surface of the base layer; and a polymer coating layer formed on the surface of the base layer, wherein he electroless plating layer is formed on the surface of the base layer where the polymer coating layer is not formed and wherein the base layer and the electroless plating layer are stacked on the key top body.

5. The key top for a pushbutton switch according to claim 4, further comprising an electroplating layer formed by electroplating on the electroless plating layer.

6. The key top for a pushbutton switch according to claim 5, wherein the polymer coating layer and the electroplating layer are formed so as to be visually recognized.

7. The key top for a pushbutton switch according to claim 1, further comprising a polymer coating layer formed on the surface of the electroless plating layer.

8. The key top for a pushbutton switch according to any one of claims 4 or 7, wherein the polymer coating layer and the electroless plating layer are formed so as to be visually recognized.

9. The key top for a pushbutton switch according to any one of claims 1 to 6, wherein the key top body comprises a resin film and a resin base that are integrated with each other.

10. The key top for a pushbutton switch according to any one of claims 1 to 6, wherein the key top body is made of a transparent resin, and wherein the transmittance of visible light of the base layer is between 3% to 95%, thereby allowing the key top to be illuminated.

11. The key top for a pushbutton switch according to claim 1, wherein the thickness of the base layer is in the range from 3 $\mu$m to 100 $\mu$m.

12. The key top for a pushbutton switch according to claim 1, wherein the thickness of the electroless plating layer is in the range from 1 nm to 50 $\mu$m.

13. The key top for a pushbutton switch according to claim 1, wherein:

the resin key top body, is made of a resin selected from the group consisting of polymethyl methacrylate (PMMA) resins, polystyrene (PS) resins, acrylonitrile/styrene copolymer (AS) resins, methyl methacrylate/styrene copolymer (MS) resins, polycarbonate (PC) resins, polyethylene (PE) resins, crystalline polyolefin resins, polycyclic norbornene methacrylate resins, and epoxy resins;

the base layer made of an insulating resin that can be plated with metal by electroless plating and formed on a surface of the key top body, wherein the resin is selected from the group consisting of acrylonitrile/butadiene/styrene (ABS) resins, polypropylene (PP) resins, polyphenylene oxide (PPO) resins, polyacetal (POM) resins, polyamide resins, and polysulfon resins, alloy resins thereof, alloy resins of polycarbonate resins, and modified resins thereof; and the electroless plating layer formed on a surface of the base layer.

14. A key top for a pushbutton switch, comprising:

a key top body, which is made of a resin that cannot be plated by electroless plating;

a base layer made of an insulating resin that can be plated with metal and formed on a surface of the key top body;

a polymer coating layer formed on a surface of the base layer; and an electroless plating layer formed on the surface of the base layer where the polymer coating layer is not formed.

* * * * *